US007641049B1

(12) United States Patent
Padgett, Sr. et al.

(10) Patent No.: US 7,641,049 B1
(45) Date of Patent: Jan. 5, 2010

(54) SELF-WARMING SANITARY WIPE APPARATUS

(76) Inventors: William P. Padgett, Sr., 363 Mark St., Gaston, SC (US) 29053; Jenny E. Padgett, 363 Mark St., Gaston, SC (US) 29053

( * ) Notice: Subject to any disclaimer, the term of this patent is extended or adjusted under 35 U.S.C. 154(b) by 471 days.

(21) Appl. No.: 11/533,017

(22) Filed: Sep. 19, 2006

(51) Int. Cl.
*B65D 77/00* (2006.01)

(52) U.S. Cl. ..... 206/494; 221/45; 221/63

(58) Field of Classification Search ..... 206/494, 206/205, 233, 581, 812, 823; 221/45, 63
See application file for complete search history.

(56) References Cited

U.S. PATENT DOCUMENTS 3,982,659 A * 9/1976 Ross ..... 221/63
6,315,114 B1 * 11/2001 Keck et al. ..... 206/210
2004/0185065 A1 * 9/2004 Ahmad et al. ..... 424/400
2006/0018953 A1 * 1/2006 Guillon et al. ..... 424/443

* cited by examiner

*Primary Examiner*—Stephen Garbe
*Assistant Examiner*—Rishi Verma
(74) *Attorney, Agent, or Firm*—Crossley Patent Law; Mark A. Crossley

(57) ABSTRACT

A self-warming sanitary wipe apparatus comprising a container with lid, stepped lip, and seal across the lip. The container further comprises an indented outlet with overlapping leaves which prevent air incursion into the container. Specifically interactively folded wipes are housed within the container and are dispensed progressively from the outlet. The wipes are saturated with an emollient, a disinfectant, and a warming gel. The warming get provides and exothermic reaction when exposed to air, thereby self-warming the wipes.

8 Claims, 4 Drawing Sheets

FIG. 1
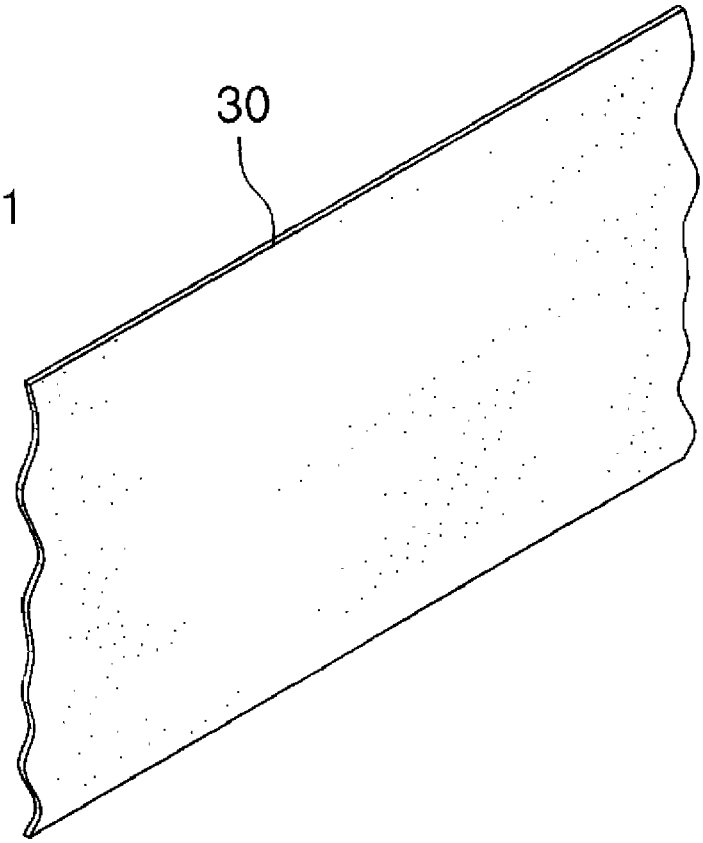
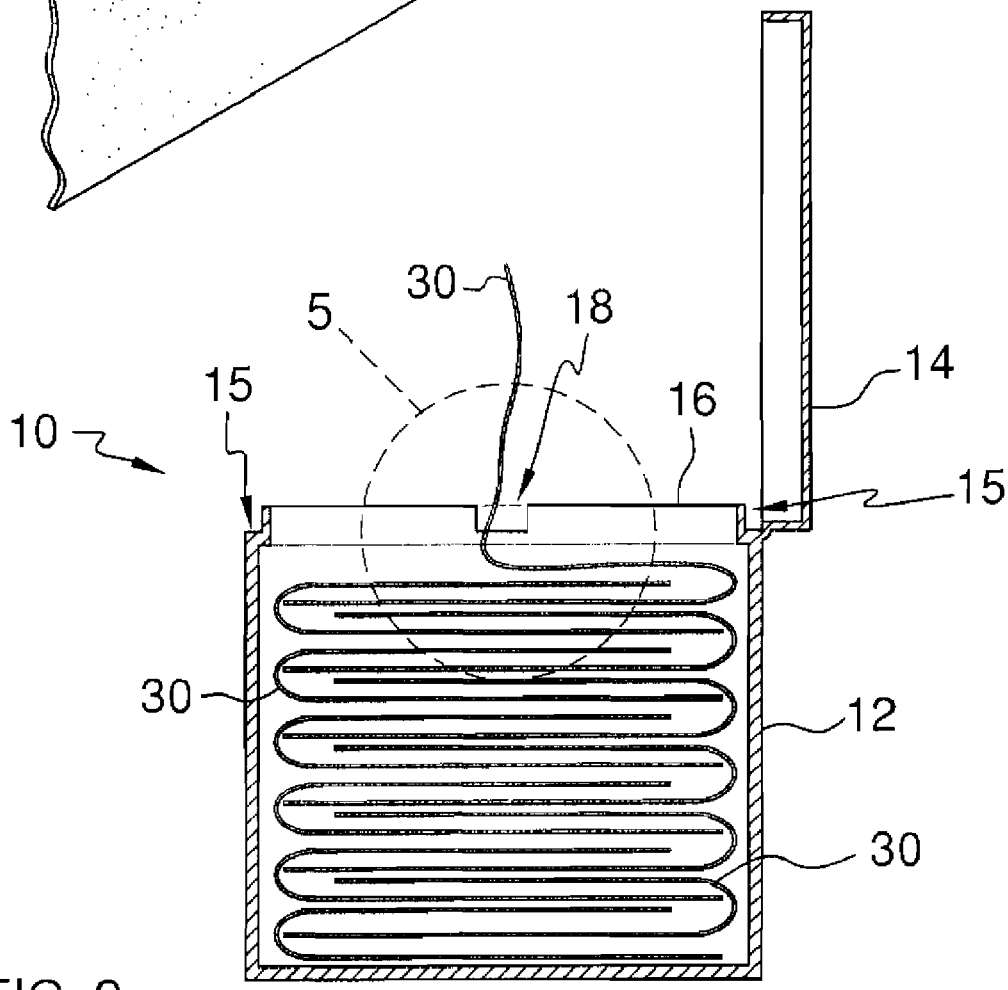
FIG. 2

SELF-WARMING SANITARY WIPE APPARATUS

BACKGROUND OF THE INVENTION

Sanitary wipes are used to cleanse and treat the skin of individuals. Sanitary wipes are especially useful in cleaning babies. It is desirable to use warm wipes in any use as the cold of most wipes is unpleasant, especially to babies. Various sanitary wipe warmers have been provided in prior art. However, warmers for use with sanitary wipe packages cannot offer complete convenience, as an electrical outlet or at least batteries are needed as an energy source for operating the warmers. What are needed is self-warming sanitary wipes that are individually dispensed from a container.

FIELD OF THE INVENTION

The self-warming sanitary wipe apparatus relates to sanitary wipes and containers of same and more especially to a sanitary wipe apparatus that comprises a container of sanitary wipes that provides self-warming wipes upon removal.

DESCRIPTION OF THE PRIOR ART

Prior related art U.S. Pat. No. 5,425,975 issued to Koiso et al. on June 20, 1995 teaches a sheet-shaped heat-generating body. The body contains an oxidizable metal power dispersed in and supported by a substrate. The device is typically used to warm a human body and does not provide usable, moist wipes or a container there for. U.S. Pat. No. 3,889,804 issued to Ravich on June 17, 1975 teaches a disposable wet towel characterized by an ability to evolve heat immediately prior to use or in use. Unlike the present apparatus, the towel does not warm with air contact, but by missing reagents prior to use. U.S. Pat. No. 2005/0067141 filed by Donovan on Mar. 31, 2005 teaches disposable towels with a chamber containing a quantity of supercooled liquid exotherm compound and a small amount of the compound in crystal form, such that the crystal and liquid are separated until time for use. The warming compounds are not activated by air contact upon removal of towels from a container, as are the present apparatus wipes.

While the above-described devices fulfill their respective and particular objects and requirements, they do not describe a self-warming sanitary wipe apparatus that provides for the advantages of the present self-warming sanitary wipe apparatus. In this respect, the present self-warming sanitary wipe apparatus substantially departs from the conventional concepts and designs of the prior art Therefore, a need exists for an improved self-warming sanitary wipe apparatus.

SUMMARY OF THE INVENTION

The general purpose of the self-warming sanitary wipe apparatus, described subsequently in greater detail, is to provide a self-warming sanitary wipe apparatus which has many novel features that result in an improved self-warming sanitary wipe apparatus which is not anticipated, rendered obvious, suggested, or even implied by prior art, either alone or in combination thereof.

To attain this, the self-warming sanitary wipe apparatus comprises a container filled with specifically folded wipes. The container has a hinged lid. The hinge is offered in more than one embodiment. One embodiment provides a plastic or polymer container and lid construction. The hinge is provided by thinner material at the intersection of the container and lid. Another embodiment provides a typical hinge. Preferably, the container, hinge, and lid are made of plastic or plastic like material. Various polymers, rubberized materials, and other lightweight composites may be used.

The container seals the wipes not only with the lid but also with another seal. The secondary seal forms an additional cover for the wipes. An indent in the seal provides a plurality of layers of flexible leaves which prevent air from entering the container. At the same time, the leaves allow wipes to be pulled from the container. The wipes are folded in the illustrated specific fashion such that the preceding wipe draws the following wipe out of the container. The leaves are, without a wipe between them, touching. The leaves are a flexible material that is specifically tensioned to provide the described seal. Although a leading edge of each wipe is exposed to open air, the interior wipes are not.

Along with the wipes, the container holds a specific liquid compound, referred to as the warming get, that is a chemical blend which saturates the wipes. Further, the wipes are also saturated in disinfectant and emollient, such as aloe vera or the like. The warming compound is comprised of propylene glycol, polyethylene glycol, hydroxypropyl cellulose, and lactic acid. This compound is oxidized upon exposure to air and becomes exothermic. The exothermic reaction causes the wipes to quickly warm. The wipes are therefore warm to the touch.

Thus has been broadly outlined the more important features of the improved self-warming sanitary wipe apparatus so that the detailed description thereof that follows may be better understood and in order that the present contribution to the art may be better appreciated.

An object of the self-warming sanitary wipe apparatus is to warm the wipes upon open air contact.

Another object of the self-warming sanitary wipe apparatus is to provide disinfectant.

A further object of the self-warming sanitary wipe apparatus is to provide a skin emollient.

An added object of the self-warming sanitary wipe apparatus is to prevent significant open air invasion of the container.

And, an object of the self-warming sanitary wipe apparatus is to provide automatic feed of the next wipe within the container.

These together with additional objects, features and advantages of the improved self-warming sanitary wipe apparatus will be readily apparent to those of ordinary skill in the art upon reading the following detailed description of presently preferred, but nonetheless illustrative, embodiments of the improved self-warming sanitary wipe apparatus when taken in conjunction with the accompanying drawings.

In this respect, before explaining the current embodiments of the improved self-warming sanitary wipe apparatus in detail, it is to be understood that the self-warming sanitary wipe apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved self-warming sanitary wipe apparatus. It is therefore important that the claims be regarded as including such equivalent constructions insofar as they do not depart from the spirit and scope of the self-warming sanitary wipe apparatus. It is also to be understood that the phraseology and terminology employed herein are for purposes of description and should not be regarded as limiting.

BRIEF DESCRIPTION OF THE DRAWINGS

FIG. 1 is a perspective view of a wipe.

FIG. 2 is a cross sectional view of the apparatus.

DETAILED DESCRIPTION OF THE DRAWINGS

Figure 3:
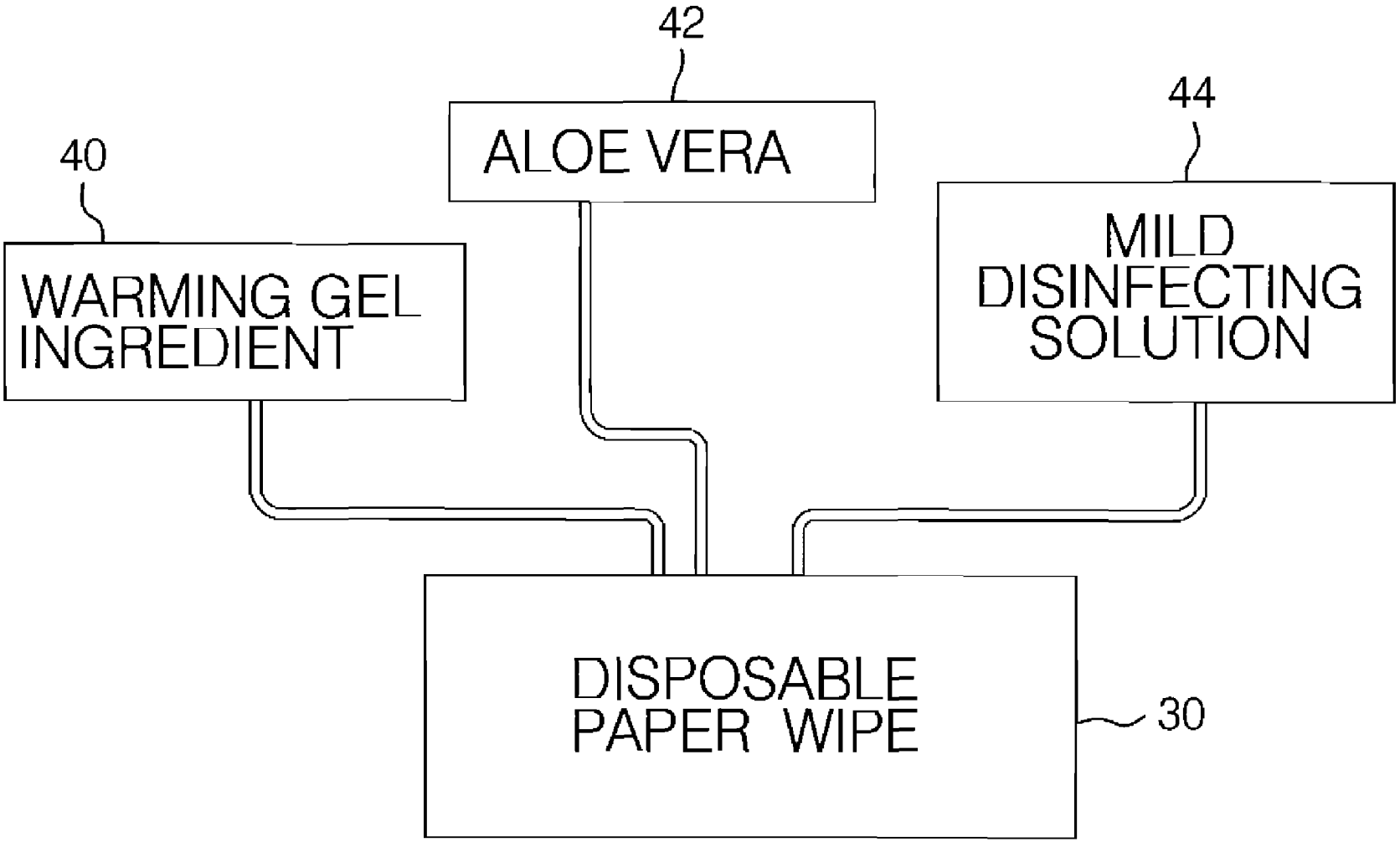
FIG. 3 is block diagram of the ingredients in the container's solution.

With reference now to the drawings, and in particular FIGS. 1 through 5 thereof, the principles and concepts of the self-warming sanitary wipe apparatus generally designated by the reference number 10 will be described.

Referring to FIG. 1, each wipe 30 of the apparatus 10 is rectangularly shaped. Each wipe 30 has a length, a thickness, and a width.

Referring to FIG. 2, the container 12 of the apparatus is of a rectangular shape with a depth. The container 12 length and width match that of the wipes 30. The container 12 further comprises a stepped lip 15 at a top edge of the container 12. The lip 15 provides for better sealing of the lid 14 to the container 12 such that the lid 14 sides and the container 12 sides are planar with the lid 14 closed. The lip 15 aids in preventing air incursion into the container 12 when the apparatus 10 is not in use. The hinged lid 14 fits snugly about the lip 15. The seal 16 is bonded to the lip 15 and extends across the top of the container 12. The wipes 30 are removably held within the container 12. Each wipe 30 is in folded contact with two other wipes 30. The overlapping folded contact of the wipes 30 provides for a wipe 30, in removal from the container, to draw the next wipe 30 to and through the outlet 18. When the first drawn wipe 30 is fully removed from the container 12, the next wipe 30 is visible. A user has the option of taking another wipe 30 or closing the lid 14 of the container 12.

Figure 5:
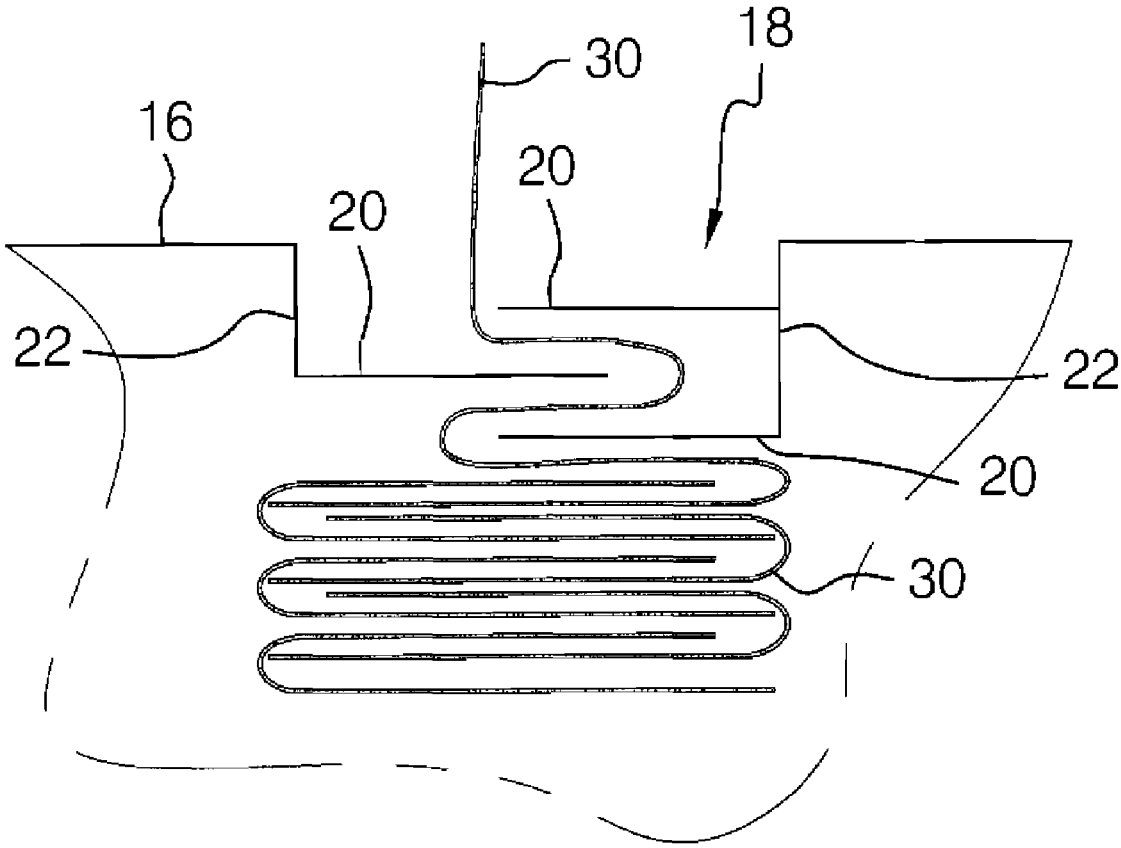
FIG. 5 is a cross sectional view of a portion of FIG. 2.

Referring to FIG. 5, the indented outlet 18 is comprised of a pair of opposed vertical spaced apart supports 22. Each support 22 has a top and a bottom. The top of each support 22 is affixed to the seal 16. The indented outlet 18 and supports 22 extend fully across the seal 16, from one side of the lip 15 to the opposite side of the lip 15. The overlapping leaves 20 are attached to the bottom of the supports 22. The leaves 20 are in the horizontal plane. Two spaced apart parallel leaves 20 are attached to one support 22. One leaf 20 is attached to the opposite support 22. The one leaf 20 is disposed partially between the opposite two leaves 20. A measured amount of tension holds the leaves 20 together in contact, when a wipe 30 is not between the leaves 20. With a wipe 30 between the leaves 20, the wipe 30 is tensioned to slightly resist withdrawal. The seal formed between the wipe 30 and the leaves 20 prevents incursion of outside air into the container 12, thereby preventing the oxidation warming reaction of air with the warming gel 40.

Figure 4:
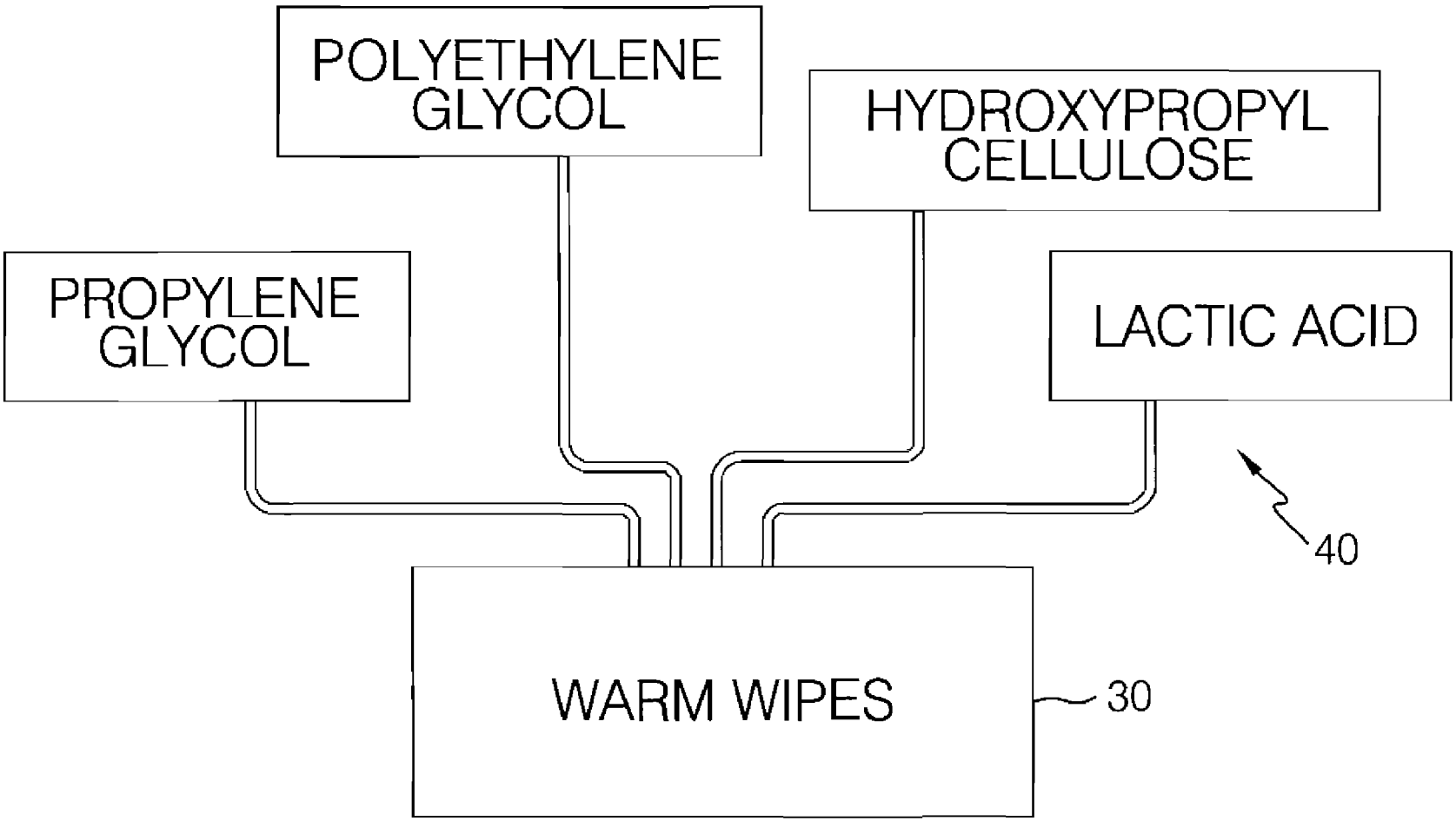
FIG. 4 is a block diagram of the warming compound.

Referring to FIGS. 3 and 4, the wipes 30 are further saturated with ingredients beneficial to sanitation and skin care. An emollient 42 is contained within the container 12 and thereby saturates the wipes 30. Aloe Vera is an example of one emollient 42 used in the apparatus 10. Emollients 42 may vary. Further, the wipes 30 are saturated with a disinfectant 44 also within the container 12.

With respect to the above description then, it is to be realized that the optimum dimensional relationships for the parts of the self-warming sanitary wipe apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the self-warming sanitary wipe apparatus.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the self-warming sanitary wipe apparatus may be used.

Therefore, the foregoing is considered as illustrative only of the principles of the self-warming sanitary wipe apparatus. Further, since numerous modifications and changes will readily occur to those skilled in the art, it is not desired to limit the self-warming sanitary wipe apparatus to the exact construction and operation shown and described, and accordingly, all suitable modifications and equivalents may be resorted to, falling within the scope of the self-warming sanitary wipe apparatus.

What is claimed is:

1. A self-warming sanitary wipe apparatus comprising, in combination:

a parallelepiped container;

a seal on a top of the container;

an indented outlet within about a center of the seal, the outlet comprising:

a pair of opposed vertical spaced apart supports, each support having a top and a bottom, the top of each support affixed to the seal;

a plurality of flexible overlapping leaves attached to the bottom of the supports, the leaves in the horizontal plane, two spaced apart parallel leaves attached to one support, one leaf attached to the opposite support, the one leaf disposed partially between the opposite two leaves, a measured amount of tension holding the leaves together;

a plurality of wipes within the container, the wipes arranged in a specific overlapping arrangement;

a liquid compound saturating the wipes, the compound exothermic when exposed to open air, the compound comprised of propylene glycol, polyethylene glycol, hydroxypropyl cellulose, and lactic acid.

2. The apparatus in claim 1 wherein the container further comprises a hinged lid.

3. The apparatus in claim 1 wherein the wipes are further saturated with an emollient within the container.

4. The apparatus in claim 2 wherein the wipes are further saturated with an emollient within the container.

5. The apparatus in claim 1 wherein the wipes are further saturated with a disinfectant within the container.

6. The apparatus in claim 2 wherein the wipes are further saturated with a disinfectant within the container.

7. The apparatus in claim 3 wherein the wipes are further saturated with a disinfectant within the container.

8. The apparatus in claim 4 wherein the wipes are further saturated with a disinfectant within the container.

* * * * *